US006845533B1

(12) United States Patent
Tulette

(10) Patent No.: US 6,845,533 B1
(45) Date of Patent: Jan. 25, 2005

(54) PATIENT TRANSPORT BOARD

(76) Inventor: James Tulette, 1914 Pattiz Ave., Long Beach, CA (US) 90815

( * ) Notice: Subject to any disclaimer, the term of this patent is extended or adjusted under 35 U.S.C. 154(b) by 0 days.

(21) Appl. No.: 10/635,975

(22) Filed: Aug. 7, 2003

Related U.S. Application Data

(60) Provisional application No. 60/408,983, filed on Sep. 5, 2002.

(51) Int. Cl.[7] ..... A61G 1/02

(52) U.S. Cl. ..... 5/626; 5/627; 5/625; 280/47.131

(58) Field of Search ..... 5/625–630; 280/47.131

(56) References Cited

U.S. PATENT DOCUMENTS

| | | | | | |
|---|---|---|---|---|---|
| 2,972,755 | A | * | 2/1961 | Abel | 5/628 |
| 3,663,972 | A | * | 5/1972 | Denton | 5/625 |
| 3,826,528 | A | * | 7/1974 | East | 296/20 |
| 4,369,982 | A | * | 1/1983 | Hein et al. | 280/47.131 |
| 4,579,381 | A | * | 4/1986 | Williams | 296/20 |
| 5,179,746 | A | * | 1/1993 | Rogers | 5/625 |
| 5,327,600 | A | | 7/1994 | Hoogendoorn | |
| 5,402,544 | A | | 4/1995 | Crawford et al. | |
| 5,493,741 | A | | 2/1996 | Baer | |
| 5,860,176 | A | * | 1/1999 | Norberg | 5/628 |
| 5,871,220 | A | * | 2/1999 | Lombard | 280/79.7 |
| 6,128,796 | A | | 10/2000 | McCormick et al. | |
| 6,158,436 | A | | 12/2000 | Watson et al. | |
| 6,175,977 | B1 | * | 1/2001 | Schumacher et al. | 5/626 |
| 6,357,063 | B1 | * | 3/2002 | Selby | 5/81.1 R |

* cited by examiner

*Primary Examiner*—Michael Trettel
(74) *Attorney, Agent, or Firm*—Stites & Harbison PLLC; John E. Vanderburgh

(57) ABSTRACT

A patient transport board comprises a flat, rigid board having a surface on which the patient lays and restraining straps for securing the patient. A pair of foldable rail members can be extended to serve as runners for moving the patient down a flight of stairs. A skid plate is provided at the foot end of the board to allow the board to be used in an upright mode for maneuvering in tight areas. In one embodiment wheel and axle assemblies are affixed at the lower end of the rail members to make easier movement of the patient transport board in an upright orientation. In another embodiment track assemblies allow for movement over rough or uneven surfaces when the patient transport board is in an upright orientation. Components of the patient transport board are foldable or removable so the board can be readily placed on a gurney or stored.

14 Claims, 4 Drawing Sheets

PATIENT TRANSPORT BOARD

This application claims the benefit of the filing date of Provisional Application Ser. No. 60/408,983, filed Sep. 5, 2002, entitled PATIENT TRANSPORT BOARD which application is incorporated by reference herein.

FIELD OF THE INVENTION

This invention relates to the transport of injured persons and more particularly to the transport of such persons through narrow hallways and down stairs such as may be encountered by firefighters and emergency medical personnel.

BACKGROUND OF THE INVENTION

Emergency Medical Service Personnel (EMS), firefighters and others involved in emergency health situations are often faced with moving an injured or incapacitated person through a confined space or down one or more flights of stairs. Conventionally, such persons are immobilized on a flat backboard for transfer to a suitable area where they can be transferred to a gurney for transportation to a hospital in an ambulance. To maneuver the board and immobilized patient through a narrow door or through a hall with tight turns requires substantial effort on the part of the personnel carrying the board. Similarly, carrying a board and patient down a flight of stairs can impose a strain on the back of those carrying the board. Except in those situations where a small child is being extricated, it will be seen that a board on which is carried a normal size person (male or female) represents a substantial amount of weight. Back injuries among firefighters and EMS personnel resulting from carrying and maneuvering patients on backboards down stairs and through confined areas are common resulting in time lost from the job, health care costs and suffering by the personnel injured.

SUMMARY OF THE INVENTION

The present invention relates to an improved emergency services transport board that can be used to maneuver an incapacitated person in an upright position through confined spaces such as narrow doors and hallways and around tight corners. In one embodiment, the device of this invention can be used as a sled for transporting an incapacitated person down a flight of stairs. The improved transport board is provided with skids and a skid pad that can be folded into a collapsed mode for easy storage on an emergency vehicle.

In another aspect of the invention the device may be provided with wheels or full track trolleys to transport a patient in a generally upright position down flights of stairs.

DESCRIPTION OF THE INVENTION

Figure 1:
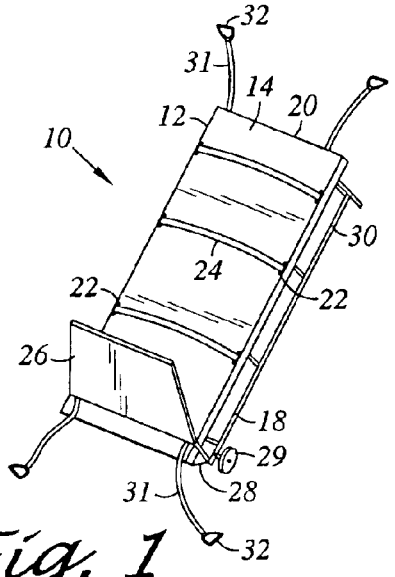
FIG. 1 is a perspective view of a transport board in accordance with the present invention.

Referring to FIGS, 1, 2 and 3, the patient transport board of the present invention, shown generally as 10, comprises a flat rigid board 12 defining an upper surface 14 on which the patient lies, a lower surface 16, a foot end 18 and a head end 20. The board is adapted for restraining the patient by the provision of opposed slots 22 located along the lateral edges of the board through which extend restraining straps 24. At the foot end 18 of the board a spring loaded foot support 26 (FIG. 2) is pivotally mounted on the upper surface 14. The foot support 26 pivots between a folded position against the upper surface 14 and, as shown, an extended position essentially vertical to the upper surface to provide a support platform for the patient when the board is non-horizontally positioned. A skid plate 28 is pivotally mounted on the lower surface 16 of the board 12 at the foot end 18 for pivoting into an extended position away from the lower surface of the board. Springs 29 normally urge the skid plate 28 into the extended position and locking clamps (not shown) hold the skid plate in the folded position against the lower surface 16 of the board 12. The skid plate 28 can provide a surface for sliding the lower end 18 of the board 12 when the board is utilized as a dolly. An opposed pair of sled rails 30 are pivotally mounted on the lower face 16 of the board 12 along essentially the length of the board parallel to its longitudinal axis. The sled rails 30 are mounted for folding between a closed position (FIG. 6*b*) against the lower face 16 of the board and an unfolded open position (FIGS. 1, 3 and 7*a* and 7*b*) essentially normal to the plane of the lower surface. The sled rails 30 are maintained in the open position by a rail support plate 32 that is pivotally mounted on the lower surface 16 at the head end 20 of the board 12 and by the skid plate 28. The skid plate 28 and the rail support plate 32 are notched at their outer corners for receiving an end portion of each sled rail 30 to prevent the sled rails from collapsing back to their closed position. The skid plate 28 also serves as a platform for supporting the patient transport board on a surface on which the skid plate will slide when the board is used in the dolly mode of operation. As an aid in maneuvering the board 12, particularly down a flight of stairs, a flexible cord 31 is attached at one end to each corner of the board and a handle 32 is attached to the opposite end of each of the cords.

In another embodiment of the invention, an axle and wheel assembly 29 is secured at the foot end of each sled rail 30 for ease in maneuvering the board 12 when using it as a dolly rather than using the skid plate 28 to slide the board on the surface. The wheel and axle assembly 29 can be permanently attached to the sled rails 30 for folding with the sled rails for storage. In another embodiment, the wheel and axle assemblies 29 may be removable to allow for placement of the patient transport board 10 on a gurney or in an ambulance and the wheel and axle assemblies separately stored.

Figure 11:
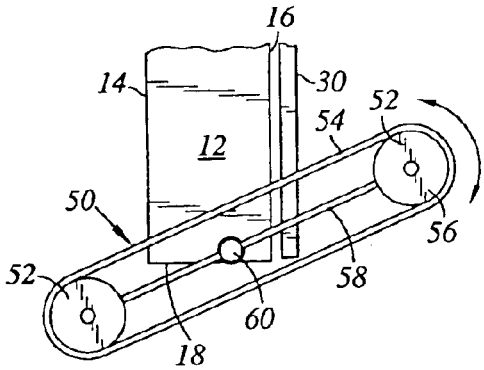
FIG. 11 is an enlarged scale, partially broken away for compactness of illustration showing an embodiment of the invention employing the full track trolley.

Referring to FIG. 11 in yet another embodiment, a pair of track assemblies 50 are affixed at the foot end 18 of the board 12. This embodiment of the invention is particularly useful for walking the patient transport board down a flight of stairs by a single individual with the board 12 in an essentially upright attitude.

Each track assembly 50 comprises a front and rear bogey wheel 52 on which is supported a suitable endless track 54. For example, flexible reinforced plastic material is highly suited for use as the track material and is readily available. The track assembly 50 further comprises an axle 56 for each bogey wheel, a tie rod 58 extending between the axles 56 and an suspension bar 60 connected to the tie rod and to the board 12. In the embodiment of the invention shown in FIG. 11, the suspension bar 60 is pivotally affixed on the board 12 to pivot about an axis that is normal to the longitudinal axis of the board so that the track assemblies 50 freely pivot to a folded position in which the track assemblies lie in a plane parallel to the upper surface 14 of the board 12. As illustrated, the suspension bar 60 is journaled at each edge of the board 12 and extends through a passage (not shown) and the track assemblies pivot simultaneously. Alternatively, a separate suspension bar 60 for each track assembly 50 is journaled in each edge of the board 12. In this case the track assemblies pivot independently of the other. In cases where it is difficult or in convenient to journal the suspension rod 60 in the board 12, a single suspension bar 60 can be pivotally affixed to the lower surface 16 of the board so that the track assemblies 50 pivot simultaneously. It is within the scope of the invention, however, that that the suspension rod 60 be non-pivotally affixed to the board 12 and that the track assemblies 50 be pivotally connected to the suspension rod for pivoting about an axis normal to the axis of the suspension rod.

Figure 2:
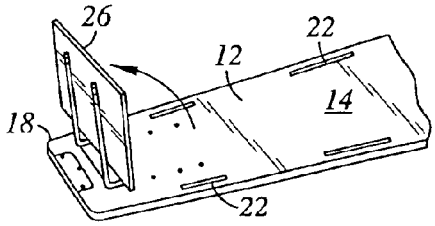
FIG. 2 is a perspective view of an end of the patient transport board partially broken away for compactness of illustration showing the spring loaded foot board.
Figure 3:
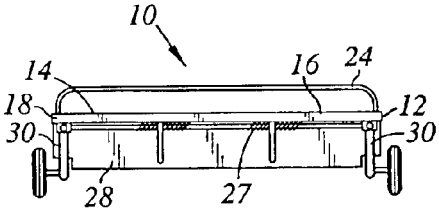
FIG. 3 is an end view of the patient transport board of the invention.
Figure 4:
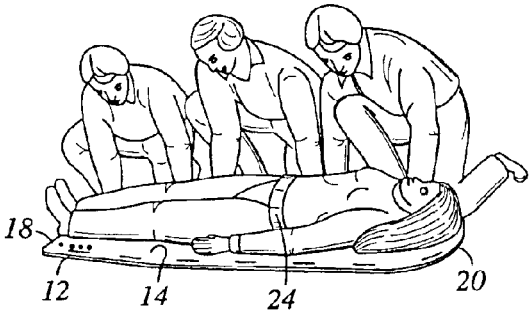
FIGS. 4–5, FIGS. 6*a*, 6*b*, 7*a*, 7*b* and 8*a* and 8*b* illustrate the steps for placing the transport board into use for transporting a patient.
Figure 5:
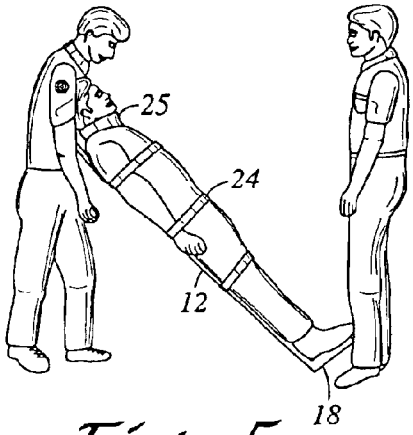
Figure 6A:
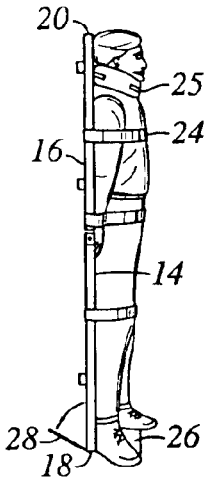
Figure 6B:
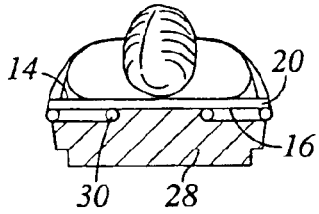
Figure 7A:
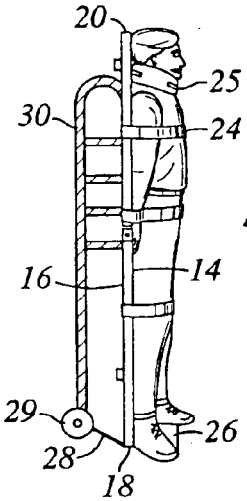
Figure 7B:
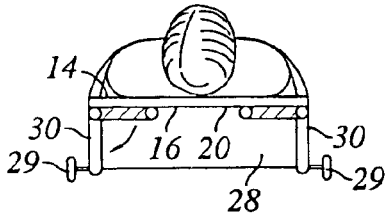
Figure 8A:
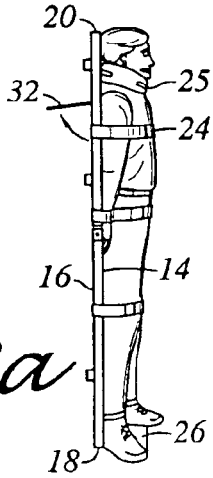
Figure 8B:
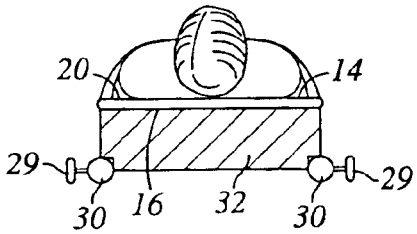

The steps for placing the patient transport board 12 in operation are shown in FIGS. 4, 5 FIGS. 6 *a* and *b* through FIGS. 8*a* and *b*. The first step is to pivot the foot support 26 from its folded position to its open position to extend substantially normal to the lower surface 16 of the board 10 as shown in FIG. 2. The patent is then placed on the board and secured by the restraining straps 24 (FIG. 4). A neck collar 25 is also placed on the patient to support the patients head. Once the patient is secured, the board 12 is lifted into a vertical position (FIG. 5) and the skid plate 28 is unfolded from its position against the lower surface 16 of the board (FIGS. 6*a* and 6*b*). The sled rails 30 are pivoted into the open position with the ends thereof restraining the skid plate 28 (FIGS. 7*a* and 7*b*). The rail support plate 32 is unfolded and the sled rails 30 are secured in the notched corners of the rail support plate (FIGS. 8*a* and 8*b*). At this point the patient transport board 10 can be utilized as a dolly with the patient supported thereon in a substantially upright position.

Figure 9:
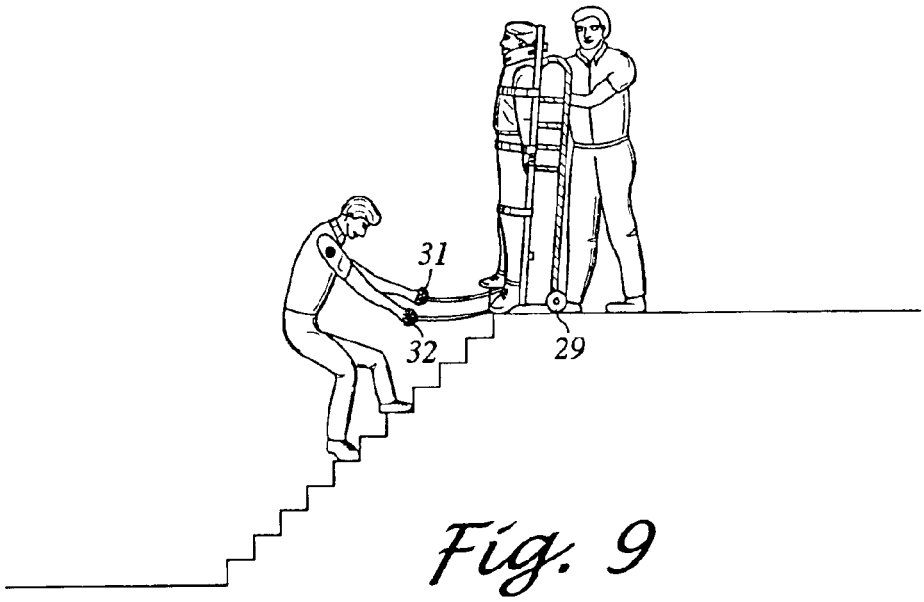
FIG. 9 illustrates the use of the transport board in the essentially vertical orientation as a dolly.

As mentioned the patient transport board 10 of the present invention can be maneuvered in tight places such making turns in narrow hallways and the like. Referring to FIG. 9, the transport board 10 can be placed in a substantially vertical orientation without harming the patient who is secured to the board 12 and is further supported in the vertical orientation by the foot support 26.

One or two attendants may maneuver the board 12. Thus, with two attendants, one attendant supports the top end 20 of the board 12, as the other attendant pulls the lower end 18 using the cords 31 and handles 32 to maneuver the board on the axle and wheel assembly 29, or if there are no wheels, causes the skid plate 28 to slide on the floor allowing the transport board to be maneuvered while in an essentially vertical position. In this position the transport board 10 is readily moved through tight hallways and the like and is easily rotated for making tight turns. It will be clear, however, with the embodiment having wheel assemblies 29 or the track assembly 50, the patient transport board 10 can be readily maneuvered by a single attendant.

Figure 10:
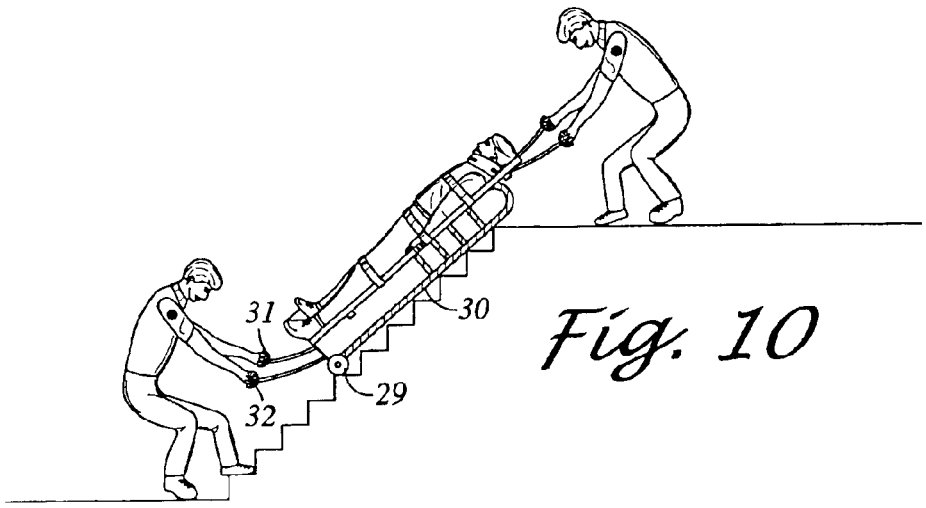
FIG. 10 illustrates one mode of use of the transport board to maneuver a patient down a flight of steps.

When the transport board is supported by the sled rails 30, the patient is readily moved down a flight of stairs. As shown in FIGS. 9 and 10, the EMS personnel use the cords 31 and handles 32 at each end of the transport board and slide the transport board on the sled rails 30 down the stairs. Use of the sled rails 30 allows for smooth descent or ascent, as the case may be, and jarring of the patient can be kept at a minimum.

Figure 14:
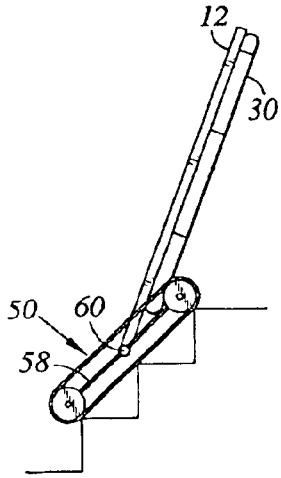
FIG. 14 illustrates the full track embodiment of FIG. 11 for maneuvering a patient down a flight of stairs.

Referring to FIG. 14, the embodiment of the invention employing the track assemblies 50 is advantageously employed in a stair descent in a substantially upright mode, much the same as in the dolly mode. The track assemblies 50 support the patient transport board 10 essentially on the edge of several steps of the staircase and provide the bogey wheels 52 with a smooth endless surface that eliminates much of the jarring that would occur if a descent of the stairs were to be attempted with the transport board in the essentially upright dolly mode of operation without the track assemblies.

Figure 13:
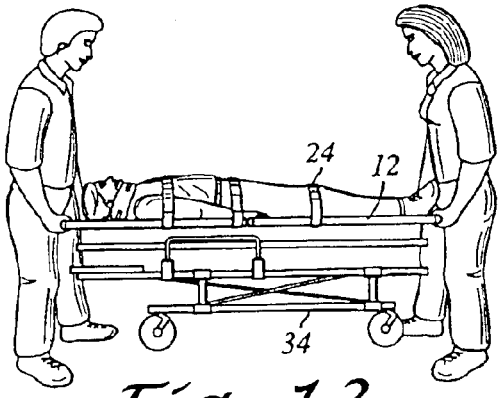
FIG. 13 shows the transport board in the fully folded mode being received on a gurney.

Once the patient is extricated from the narrow hallway and/or up or down any steps, the transport board can be returned to its folded position by reversing the steps described above. Once folded, as shown in FIG. 13, the transport board can be placed directly on a gurney for transport to an ambulance without the necessity of again moving the patient.

Figure 12:
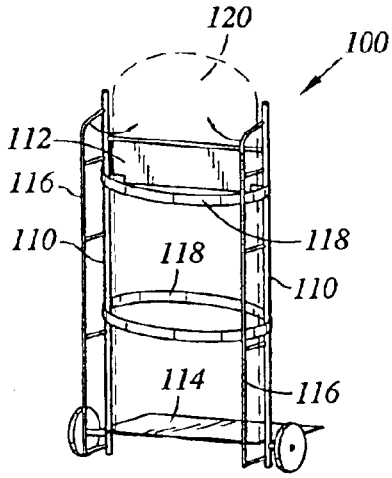
FIG. 12 illustrates another embodiment of the invention for the conversion of a conventional patient transport board into the patient transport board of the invention.

While the invention has thus far been described in connection with embodiments in which the board 12, sled rails 30, foot plate 26, wheel assemblies 29 or track assemblies 50 and support plate 32 comprise a single assembly, in many cases it may be desirable to utilize conventional transport boards by converting them to a patient transport board in accordance with the invention. Referring to FIG. 12 this is accomplished by providing a frame member, shown generally as 100 that comprises a pair of spaced apart longitudinal members 110, an upper transverse member 112 and a lower transverse member 114 that cooperate with the longitudinal members to form the frame member. The spacing between the longitudinal members 110 is substantially the width of a conventional transport board.

In the embodiment shown, the lower transverse member 114 is pivotally mounted on the longitudinal members 110 for movement between a folded position and an extended position (as illustrated) and thus serves as the foot support described above in connection with the embodiments of the invention illustrated and described in connection with FIG. 1. Likewise, the upper transverse member 112 is pivotally mounted for movement between a folded position (as shown) and an extended position to serve as the rail support plate, the function of which is described above. Sled rails 116 are pivotally mounted on the longitudinal members 110 and function as described above in connection with the embodiments of the invention illustrated in FIG. 1–FIG. 10. Straps 118 are affixed around the longitudinal members 110. A conventional transport board 120 is positioned between the longitudinal members 110 and is supported at its upper and lower ends by the upper transverse member 112 and the lower transverse member 114 respectively. Optionally wheel assemblies 122 or the track assemblies 50 of FIG. 11 are journaled at the lower ends of the sled rails 116 and are foldable with the sled rails or removable for positioning on a gurney or for storage.

Operation of the frame member 100 and transport board 120 combination is the same as the operation of the patient transport board illustrated and described above in connection with the FIGS. 1–10.

As will be understood by those skilled in the art, various arrangements which lie within the spirit and scope of the invention other than those described in detail in the specification will occur to those persons skilled in the art. It is therefor to be understood that the invention is to be limited only by the claims appended hereto.

Having defined the invention, I claim:

1. An emergency services patient transport board comprising a support board defining an essentially flat upper surface on which a patient lies, a lower surface, a foot end and a head end, at least one restraining member secured to said support board for securing a patient thereon, a foldable foot support mounted on said upper surface of said support board at said foot end thereof for movement between a folded position on said upper surface and an extended position essentially perpendicular to said upper surface, said foot support pivoting about an axis normal to the longitudinal axis of said rectangular member thereby to provide a support platform for the feet of a patient when said patient is on said support board, a skid plate mounted on said lower surface of said support board at said foot end to define a supporting surface when said support board is in a substantially vertical orientation, an opposed pair of rail members pivotally mounted on said lower surface of said support board, said rail members extending parallel to the longitudinal axis of said support board, one end of each said rail member terminating adjacent said foot end of said support member, said rail members being pivotally mounted for movement between a folded position on said lower surface of said support board and an extended position extending substantially perpendicular to said lower surface, said rail members pivoting about an axis parallel to the longitudinal axis of said support board.

2. The patient transport board of claim 1 wherein said foot support is spring loaded and normally urged by said spring into said folded position.

3. The patient transport board of claim 1 further including a support plate pivotally mounted on said lower surface at said head end of said rectangular member for pivotal movement between a folded position on said lower surface and an extended position essentially normal thereto, said support plate pivoting about an axis normal to the longitudinal axis of said rectangular member.

4. The patient transport board of claim 1 wherein said foot support and said support plate extend between said rail members and support said rail members in the extended position.

5. The patient transport board of claim 1 further including a flexible cord attached at one end to each corner of said rectangular member, each said cord having a gripping handle attached to the opposite end.

6. The patient transport board of claim 1 wherein an axle and wheel assembly is secured at said one end of each said rail member terminating adjacent said foot end of said rectangular member.

7. The patient transport board of claim 1 wherein an opposed pair of track assemblies each carrying an endless track are affixed to said rectangular member at the foot end thereof for movement of said patient transport board over uneven surfaces when said patient transport board is essentially vertically oriented.

8. The patient transport board of claim 7 wherein each said track assembly comprises a front and rear bogey wheel on which is supported said endless track, said track assembly further comprises an axle for each said bogey wheel, a tie rod extending between said axles and a suspension bar connected to said tie rod and to said support board.

9. The patient transport board of claim 8 wherein a suspension bar is journaled at each edge of said support board adjacent said foot end thereof for rotation about an axis normal to the longitudinal axis of said support board whereby each said track assembly pivots independently.

10. The patient transport board of claim 8 wherein a single suspension bar is pivotally affixed to said lower surface of said support board adjacent said foot end thereof for rotation about an axis normal to the longitudinal axis of said rectangular member whereby said track assemblies pivot simultaneously.

11. The patient transport board of claim 8 wherein said suspension rod is affixed to said support board and said track assemblies are pivotally connected to said suspension rod for pivoting about an axis normal to the axis of said suspension rod.

12. Apparatus for converting a patient transport board to an emergency patient transport board capable of transporting a patient in the horizontal orientation and an essentially vertical orientation, said apparatus comprising:

a frame member comprising a pair of spaced apart longitudinal members, the spacing between said longitudinal members being sufficient to receive a patient transport board, upper and lower transverse members, a rail member pivotally mounted on each said longitudinal members for pivoting about an axis parallel to the axis of said longitudinal member for movement between a retracted position and an extended position, said lower transverse member being pivotally affixed to said longitudinal members for pivoting about an axis perpendicular to said longitudinal members for movement between a folded position essentially parallel to said longitudinal members and an extended position substantially normal to said longitudinal members to define a supporting surface for a patient when a patient transport board is received between said longitudinal members and said board and frame are in an essentially vertical orientation, said upper transverse member being pivotally mounted for movement about an axis perpendicular to said longitudinal members for movement between a folded position essentially parallel to said longitudinal members and an extended position substantially normal to said longitudinal members between said rail members when said rail members are in the extended position thereby to support said rail members in the extended position.

13. The apparatus of claim 12 further including at least one restraining strap extending between said longitudinal members and secured thereto.

14. The apparatus of claim 12 further including a generally rectangular member having a flat upper surface secured between said longitudinal members and said upper and lower transverse members.

* * * * *